US009387967B2

(12) United States Patent
Curry et al.

(10) Patent No.: US 9,387,967 B2
(45) Date of Patent: Jul. 12, 2016

(54) SAFETY METAL STRAP

(71) Applicants: Scott Curry, San Marcos, CA (US); Rich Dicker, San Diego, CA (US)

(72) Inventors: Scott Curry, San Marcos, CA (US); Rich Dicker, San Diego, CA (US)

( * ) Notice: Subject to any disclaimer, the term of this patent is extended or adjusted under 35 U.S.C. 154(b) by 147 days.

(21) Appl. No.: 13/711,890

(22) Filed: Dec. 12, 2012

(65) Prior Publication Data

US 2014/0158582 A1 Jun. 12, 2014

(51) Int. Cl.
*B26B 27/00* (2006.01)
*B65B 69/00* (2006.01)
*B65D 71/04* (2006.01)

(52) U.S. Cl.
CPC ..... *B65D 71/04* (2013.01)

(58) Field of Classification Search
CPC ..... B65D 71/00; B65D 63/00; B65D 65/38; B65D 67/00; B65D 67/02; B65D 63/02; B65B 69/0033; B65B 39/0025
USPC ... 24/16 R, 304, 17 R, 17 B, 20 R, 22, 704.2, 24/457; 248/683, 205.3
See application file for complete search history.

(56) References Cited

U.S. PATENT DOCUMENTS 151,036 A * 5/1874 Liebenroth ..... 24/17 A
2,184,960 A * 12/1939 Lau ..... 24/23 W
2,214,110 A * 9/1940 Ott ..... 72/331
2,512,982 A * 6/1950 Tinnerman ..... 24/16 R
2,536,023 A 1/1951 Besner
2,711,584 A 6/1955 Crider
2,719,258 A 9/1955 Lassen
3,599,328 A * 8/1971 Ursetta ..... 30/128
3,629,883 A 12/1971 Norman
3,791,031 A 2/1974 Brothers et al.
3,831,280 A * 8/1974 Brothers et al. ..... 30/296.1
4,802,325 A 2/1989 Duncan
4,908,944 A * 3/1990 Brothers ..... 30/2
5,535,932 A * 7/1996 Ruczienski ..... 225/1
6,151,783 A 11/2000 Morales
6,317,933 B1 * 11/2001 Suenaga ..... 24/16 R
7,255,313 B2 * 8/2007 Lane ..... 248/222.41
7,624,480 B2 * 12/2009 Coronel ..... 24/306
8,516,661 B2 * 8/2013 Maskell ..... 24/23 R
2005/0186417 A1 * 8/2005 Rodriguez ..... 428/343
2009/0013503 A1 * 1/2009 Hays ..... 24/17 R
2010/0229509 A1 * 9/2010 Mills ..... 54/82
2014/0047676 A1 * 2/2014 Rothbaum et al. ..... 24/17 R

OTHER PUBLICATIONS hookandloop.com, waybackmachine—Sep. 14, 2012.*

* cited by examiner

*Primary Examiner* — Robert J Sandy
*Assistant Examiner* — Jason W San
(74) *Attorney, Agent, or Firm* — Muskin & Farmer LLC

(57) ABSTRACT

A method and apparatus to provide for a safe way to attach and remove metal strapping from a pallet or other shipping structure. The metal strapping is attached to a safety device which receives the metal strap before it is tightened around shipping materials. The metal strap is then tightened and the safety device is secured to the metal strap. After the materials reach their destination, the metal strap is then cut at the safety device and the safety device restrains the metal strap from whipping back and causing injury to anyone.

5 Claims, 8 Drawing Sheets

SAFETY METAL STRAP

BACKGROUND OF THE INVENTION

1. Field of the Invention

The present general inventive concept is directed to a method, apparatus, and computer readable storage medium directed to a safety strap used for banding/strapping together a pallet and preventing the strap from whipping recklessly when it is cut.

2. Description of the Related Art

Pallets are loaded with materials (e.g., boxes, lumber, etc.) and then sealed with a metal strap wrapped around the materials and tightened. FIG. 1 is a prior art drawing of a pallet with a box and a metal strap placed around it.

In order to apply the metal strap, the metal strap is placed around the materials and then a tensioner is used to tighten the metal strap. It is important that the metal strap is secured tightly around the materials so that they do not loosen during transit. The tensioner comprises four main components: cutter, ratchet, clamp, and handle. The strap is wrapped around the materials with about 6-8 inches of overlap (extra strapping) and then the cutter is used to cut the strap. One end of the strap is placed inside the tensioner. The other end of the strap is also placed inside the tensioner thought the ratchet. The handle in the tensioner is then raised/lowered continuously which tightens the strap (brings both ends of the metal strap together). A clip is then placed around both pieces of the strap and a sealer is opened, pushed over the clip and the both arms of the sealer are closed together, which tightens (seals) the clip onto both pieces of the strap thereby sealing the strap together. The tensioner can then be removed and the strap has now been tightly sealed over the materials and is ready for transport.

When the pallet reaches its destination, the metal strap is removed by cutting it with a cutting tool. One problem with cutting the metal strap is that because the metal strap has been placed so tightly, upon cutting, both ends of the metal strap are whipped around due to the release of the tension since it was wrapped so tightly. Upon being cut, the whipping ends of the metal strap can present a dangerous condition.

What is needed is a safer way to remove the metal strapping from a pallet.

SUMMARY OF THE INVENTION

It is an aspect of the present invention to provide a safe apparatus and method to seal a metal strap around shipping materials and remove the strap.

The above aspects can be obtained by (a) a restraining section with a first arm and a second arm; (b) a top adhesive strip; and (c) a bottom adhesive strip.

The above aspects can also be obtained by a method that includes (a) providing a safety device comprising: (i) a restraining section with a first arm and a second arm; (ii) a top adhesive strip; and (iii) a bottom adhesive strip. (b) wrapping a metal strap around shipping materials; (c) placing the safety device under the metal strap; (d) tightening the strap around the shipping materials; and ϵ sealing the metal strap to the safety device.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
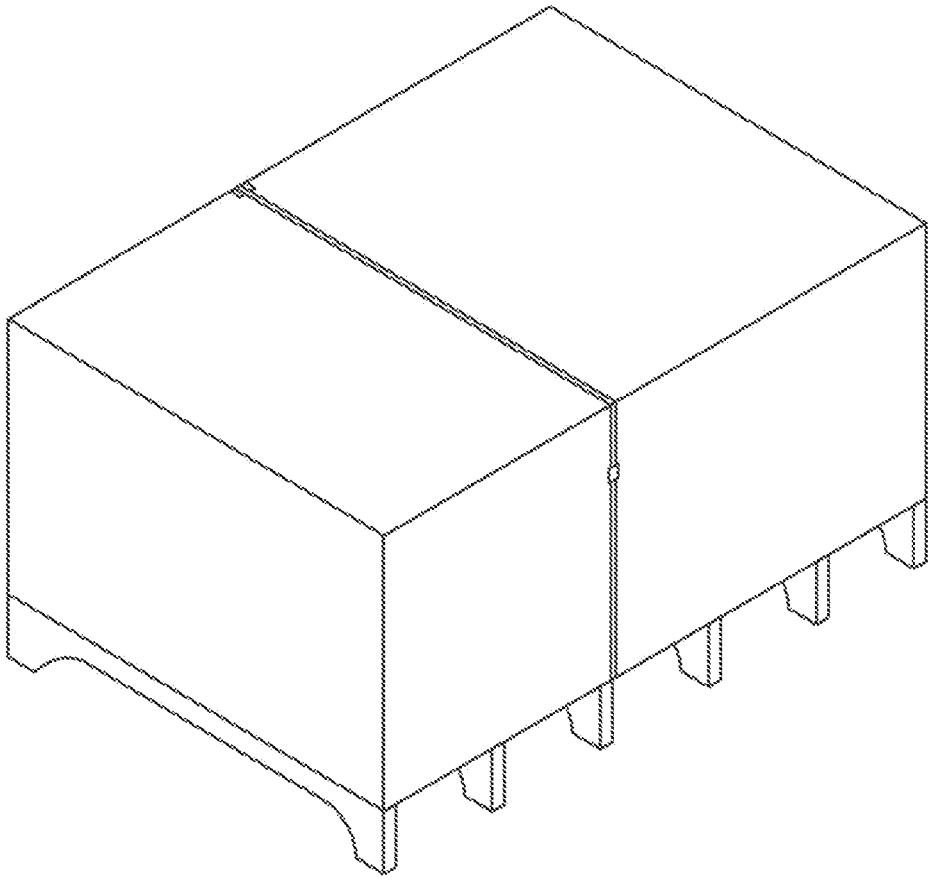
FIG. 1 is a prior art drawing of a pallet with a box and a metal strap placed around it.

Reference will now be made in detail to the presently preferred embodiments of the invention, examples of which are illustrated in the accompanying drawings, wherein like reference numerals refer to like elements throughout.

The present inventive concept relates to a method and apparatus to seal a metal strap (also known and referred to as a metal band) around cargo (e.g., boxes, wood, etc.) so that it can be removed in a safe manner. The concept provides a safety device which is placed under the metal strap before the strap is tightened. When the strap is cut (typically after the cargo is delivered) the strap is cut where the safety device is. The safety device restrains both ends of the metal strap so they do not fly (whip) around.

Figure 2:
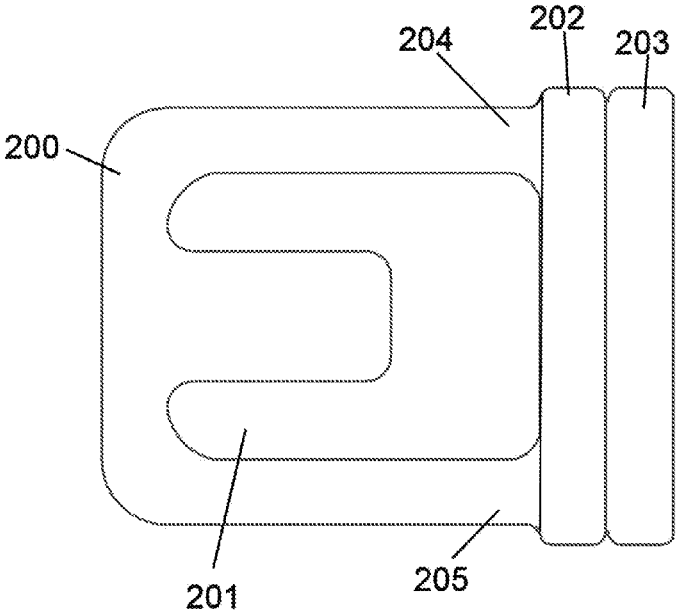
FIG. 2 is a drawing of a safety device, according to an embodiment.

FIG. 2 is a drawing of a safety device, according to an embodiment.

The entirety of the safety device is illustrated in FIG. 2, all parts shown are secured together. A restraining section 200 has an opening 201 inside the restraining section 200. In other words, opening 201 is empty space and is cut out of the restraining section. The restraining section 200 can be made of a strong material that can twist, stretch, and bend but not tear. The restraining section 200 can for example be made out of rubber, plastic, silicone, or any other suitable material. The restraining section 200 comprises a first arm 204 and a second arm 205. The restraining section 200 is connected to a bottom adhesive strip 202 which is connected to a top adhesive strip 203.

The bottom adhesive strip 202 and/or the top adhesive strip 203 come with an adhesive applied so that when the top adhesive strip 203 is folded over the bottom adhesive strip 202

Figure 10:
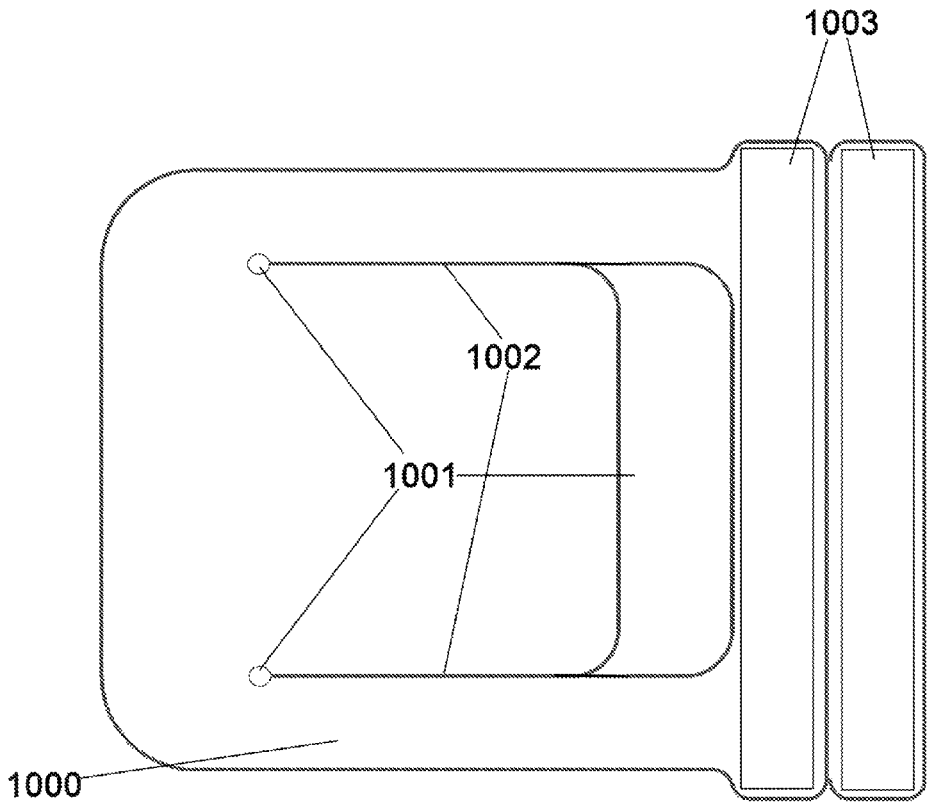
FIG. 10 is a drawing of another embodiment of a safety device, according to an embodiment.

(after the metal strap is placed therebetween), the top adhesive strip is secured extremely firmly to the bottom adhesive strip 202. One such adhesive that can be used is glue which is pre-applied to the bottom adhesive strip 202 or the top adhesive strip 203 and a plastic coating (not shown in FIG. 2 but plastic coating 1003 is shown in FIG. 10 and can be used identically in FIG. 2) can be peeled off thereby removing and exposing pre-applied adhesive (glue, epoxy, etc.) which is ready to bond to whatever material is applied to it (the strap). Alternatively, the user can manually affix an adhesive (e.g., glue, cement, etc.) to the top adhesive strip 203 and/or the bottom adhesive strip 202.

Note that FIG. 2 shows one shape of the restraining section 200, other shapes can be used for the restraining section 200 as well, for example see FIG. 10. In an embodiment, the restraining section 200 can also be solid, without any opening.

Figure 3:
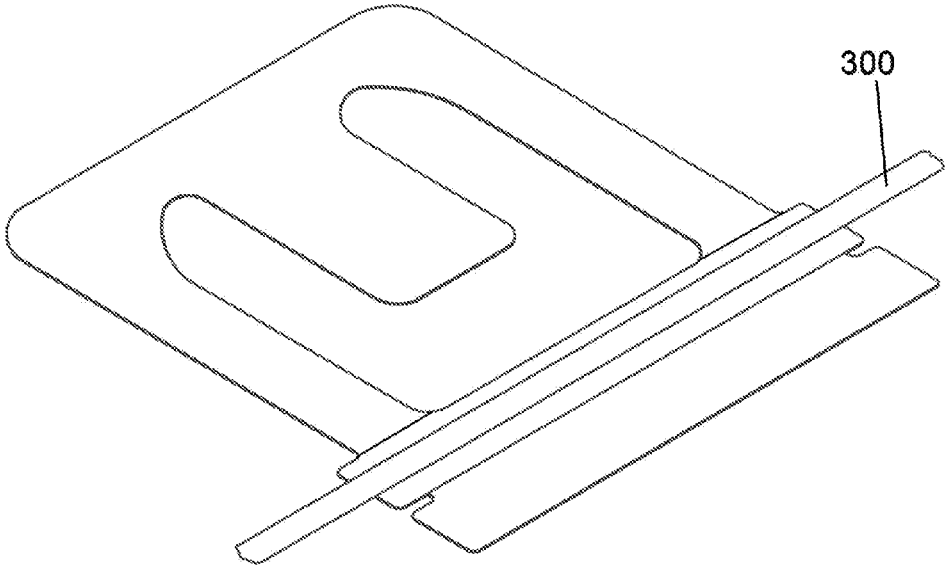
FIG. 3 is a drawing of a strap placed on the safety device, according to an embodiment.

FIG. 3 is a drawing of a strap placed on the safety device, according to an embodiment.

A metal strap 300 is placed over the bottom adhesive strip 202. Alternatively, the metal strap 300 can be placed over the top adhesive strip 203.

Figure 4:
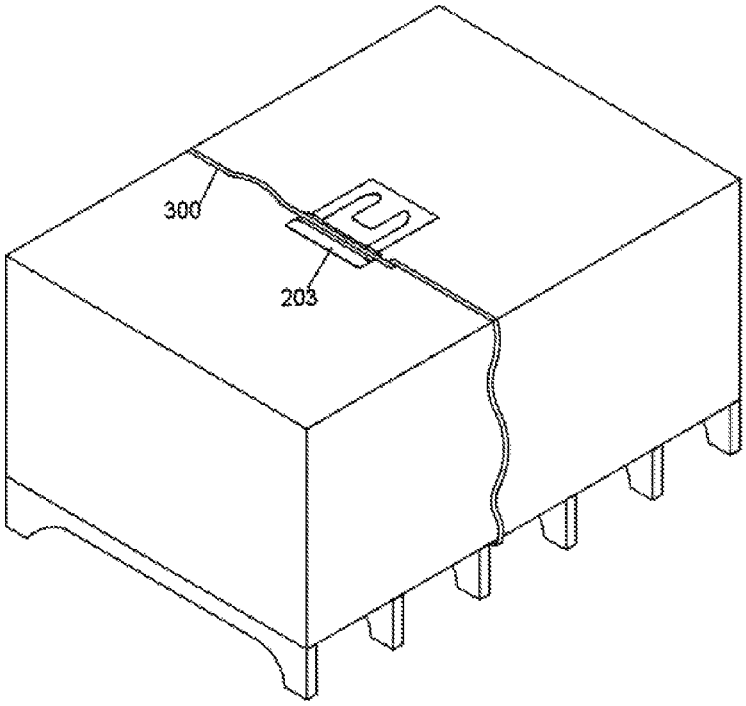
FIG. 4 is a drawing of a loosened strap placed over the safety device, according to an embodiment.

FIG. 4 is a drawing of a loosened strap placed over the safety device, according to an embodiment.

The safety device is placed on top of the materials and under the metal strap 300 as illustrated in FIG. 4. The strap 300 is placed over the bottom adhesive strip 202.

Figure 5:
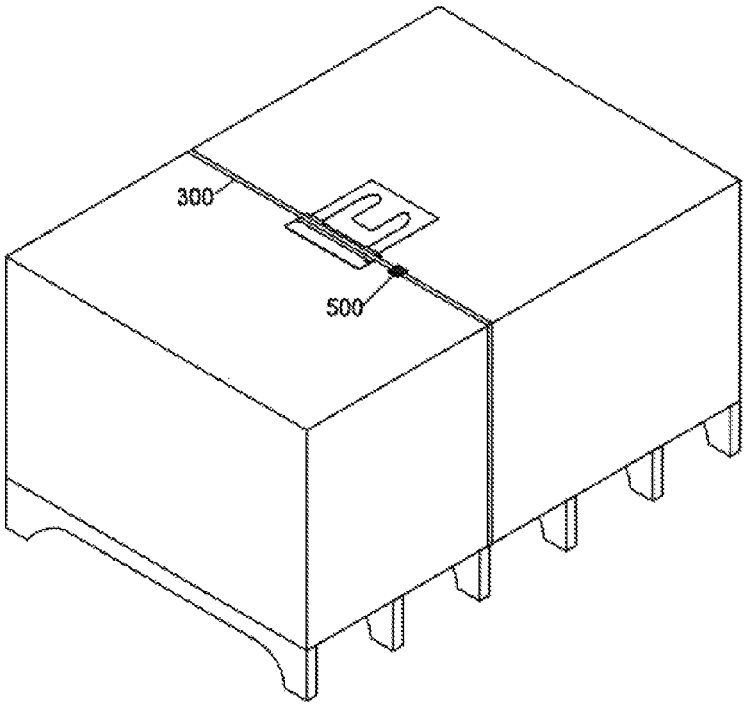
FIG. 5 is a drawing of a tightened strap placed over the safety device, according to an embodiment.

FIG. 5 is a drawing of a tightened strap placed over the safety device, according to an embodiment.

The user would use a tensioner to tighten the metal strap around the materials. The user then places a clip 500 around both ends of the metal strap and uses a sealer to seal the clip to the ends of the metal strap. Now the metal strap 300 is tightened (secured) around the materials (box) and not easily removed.

Figure 6:
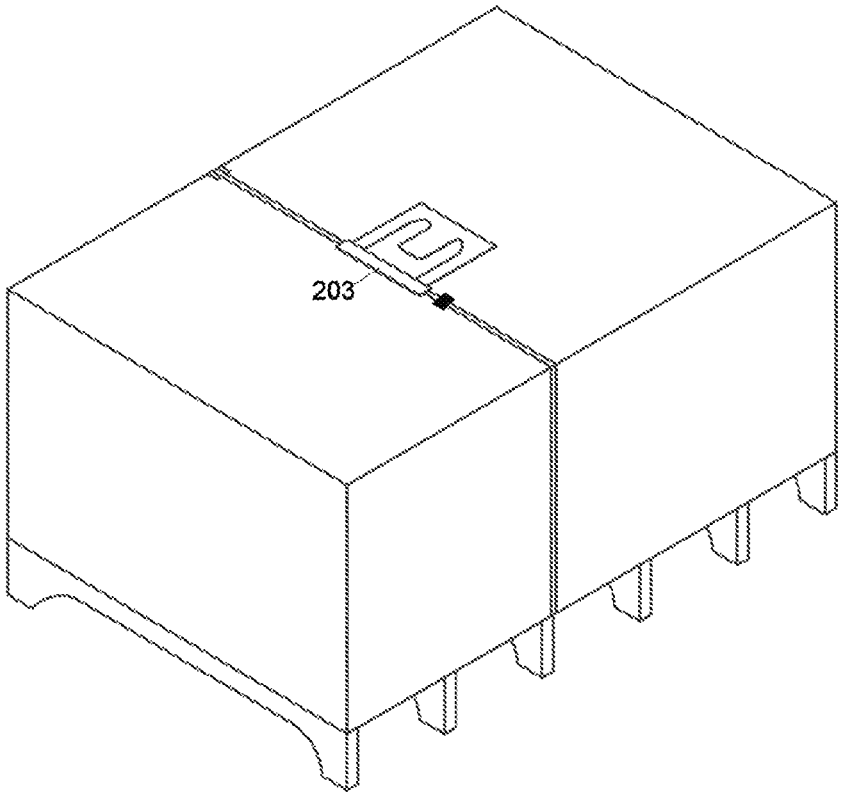
FIG. 6 is a drawing of the tightened strap placed over the safety device with the adhesive flap sealed over the strap, according to an embodiment.

FIG. 6 is a drawing of the tightened strap placed over the safety device with the adhesive flap sealed over the strap, according to an embodiment.

The top adhesive strip 203 is folded over to affix to the bottom adhesive strip 202 (covered in FIG. 6 by the top adhesive strip 203). The top adhesive strip 203 is affixed to the bottom adhesive strip 202 via an adhesive (which can be pre-applied to the top adhesive strip 203 and/or the bottom adhesive strip 202) or can be applied by the user. The adhesive should also maintain a strong bond to the portion of the metal strap that is between the top adhesive strip 203 and the bottom adhesive strip 202, so when the metal strap is cut (at the top adhesive strip 203 and the bottom adhesive strip 202) the metal strap does not slide outside of the top adhesive strip 203 and the bottom adhesive strip 202.

Figure 7:
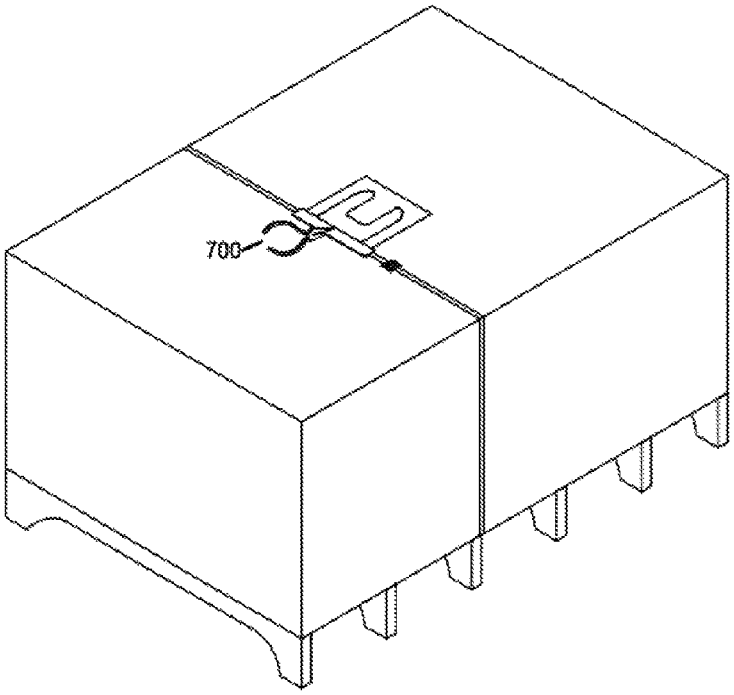
FIG. 7 is a drawing of the tightened strap placed over the safety device with the adhesive flap sealed over the strap about to be cut, according to an embodiment.

FIG. 7 is a drawing of the tightened strap placed over the safety device with the adhesive flap sealed over the strap about to be cut, according to an embodiment.

When the box/materials are shipped and reach their destination, it is time for the metal strap to be cut. A cutter 700 is used to cut the metal strap at a point where the top adhesive strip 203 and the bottom adhesive strip 202 are folded over. The cutter (such as a pair of scissors or other type of cutter such as pliers, etc.) would typically have sharp blades to be able to cut through the metal strap.

Figure 8:
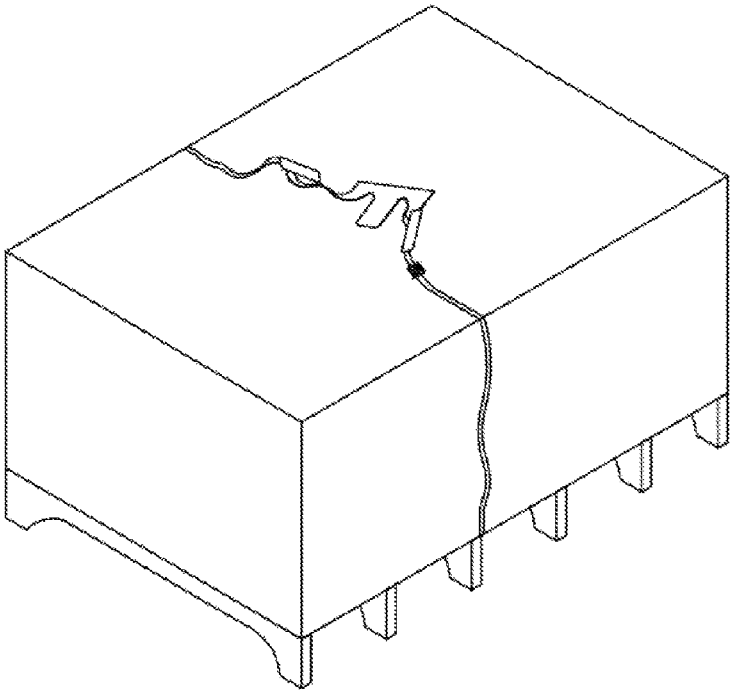
FIG. 8 is a drawing of the tightened strap cut through the safety device, according to an embodiment.

FIG. 8 is a drawing of the tightened strap cut through the safety device, according to an embodiment.

After being cut, the metal strap is now restrained by the restraining section of the safety device which bends and twists but does not tear or break, thereby preventing the cut ends of the metal strap from whipping around and hurting anyone. The restraining section would now be cut (using the same cutter 700 or a different cutter) to allow easy removal of the metal strap (or alternatively the metal strap can be slid off the end of the box). The metal strap can now be safely removed from the materials without the prospect of harm to anyone.

Figure 9:
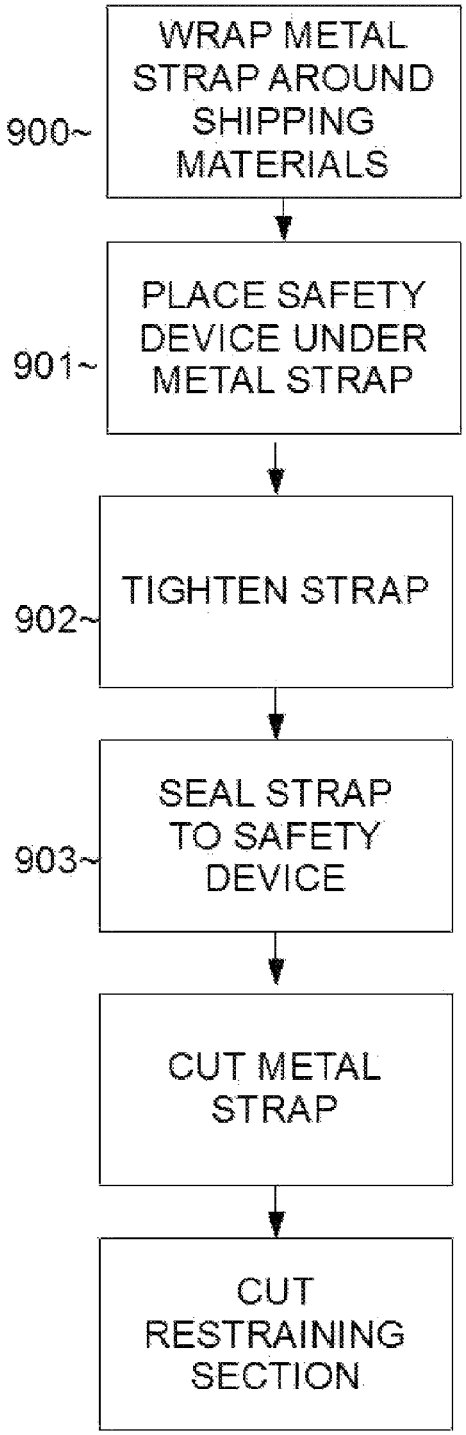
FIG. 9 is a flowchart illustrating the method of utilizing the safety device, according to an embodiment.

FIG. 9 is a flowchart illustrating the method of utilizing the safety device, according to an embodiment.

The user would already possess a safety device as described herein. The method would begin with operation 900, wherein the user wraps the metal strap around the shipping materials (boxes, wood, cargo, etc.) It is noted that more than one metal strap can be wrapped round the shipping materials and each metal strap would be installed and removed as described herein. The user can wrap the metal strap snug but there would still be a little looseness in the metal strap in order to effectuate operation 901.

From operation 900, the method proceeds to operation 901, wherein the user places the safety device under the metal strap (as illustrated in FIG. 4).

From operation 901, the method proceeds to operation 902, wherein the user tightens the strap which includes sealing it. As described herein, the user uses a tensioner (which are known in the art) to wrap the ends of the strap tightly. The user can also use the tensioner (or a separate cutter) to cut the metal strap to the proper length. The user then places a clip around two ends of the strap and uses a sealer to seal (crimp) the strap together around the clip. There still may be a bit of extra metal strap (e.g., 0-3 inches) on each of the ends of the metal strap after the clip. Now that the metal strap is sealed around the shipping materials, the tensioner can be removed.

From operation 902, the method proceeds to operation 903, wherein the user now seals the strap to the safety device. This can be done in numerous ways. For example, adhesive can be exposed in the top adhesive strip (e.g., by peeling away plastic, etc.) and/or the bottom adhesive strip, or adhesive can be introduced to the top adhesive strip and/or the bottom adhesive strip by the user. The top adhesive strip can now be folded over to the bottom adhesive strip and the adhesive seals the top adhesive to the bottom adhesive strip and also the metal strap inside so that the metal strap is secured between the top adhesive strip and the bottom adhesive strip.

The shipping materials (which may or may not include a pallet) can now be shipped as normal. The recipient simply uses a cutter (the same cutter that would be used to cut the metal strap directly) to cut the metal strap at a point where the top adhesive strip and the bottom adhesive strip are (see FIG. 7). The safety device now restrains the ends of the strap that have been cut so the ends do not whip around. Each end is securely adhered (by virtue of the adhesive) inside its respective portion of the top adhesive strip and bottom adhesive strip (which is now in two pieces) so that the metal strip cannot escape and whip out.

The user can now simply peel off the metal strap from the shipping materials. If the user wants to still have the metal strap cut so that the metal strap can be pulled out, the user can simply cut the restraining section or just cut another portion of the metal strap (not at the top adhesive strip/bottom adhesive strap) and then pull out the metal strap.

FIG. 10 is a drawing of another embodiment of a safety device, according to an embodiment.

The safety device illustrated in FIG. 10 operates exactly as the safety device described herein and merely has a different shape/structure. The restraining section 1000 is solid and is made out of rubber, plastic, silicone, or any other suitable material. Openings 1001 are holes within the restraining section 1000. Slits 1002 are slits cut into the restraining section 1000. Plastic coating 1003 (also can be referred to as removable tape or liner or coating) covers adhesive (glue, cement, epoxy, or any adhesive) that is pre-applied behind the plastic coating 1003 (e.g., the adhesive is shielded between the restraining section 1000/adhesive strips and the plastic coating 1003). The plastic coating 1003 is adapted to be easily peeled off, thereby exposing the adhesive which is wet and ready to adhere to something (the strap is then placed on the adhesive as described herein). The adhesive and coating can be located on the top adhesive strip, the bottom adhesive strip, or both.

Figure 11:
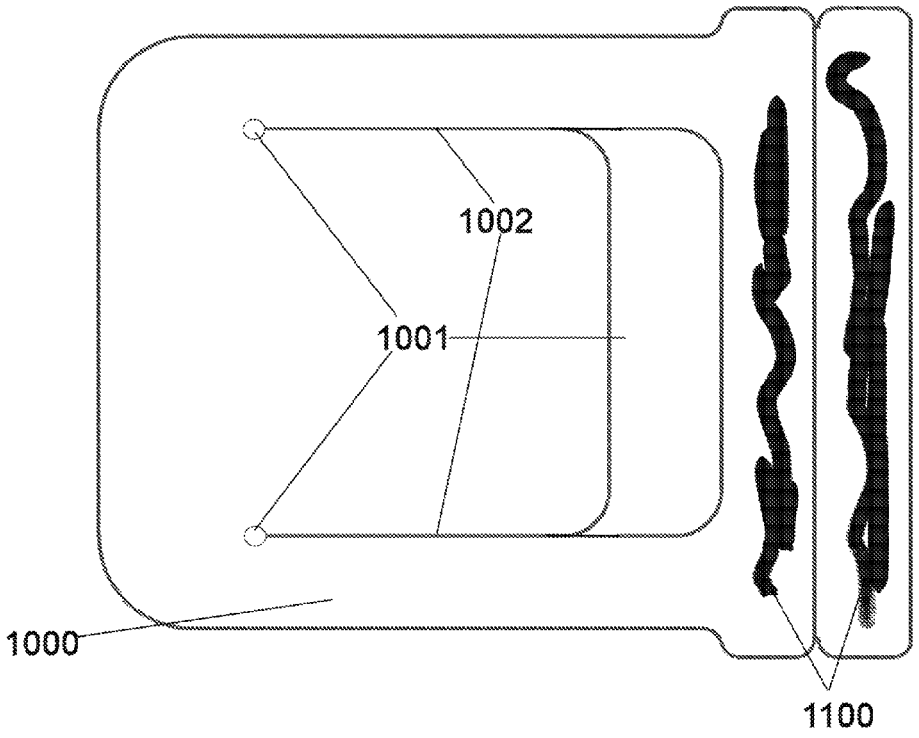
FIG. 11 is a drawing of another embodiment of a safety device with the adhesive exposed, according to an embodiment.

FIG. 11 is a drawing of another embodiment of a safety device with the adhesive exposed, according to an embodiment.

When the coating 1003 is peeled off, the adhesive 1100 is exposed and ready to stick. This is when the strap is positioned on the top adhesive strip or the bottom adhesive strip and the top adhesive strip is folded over the bottom adhesive strip, as described herein. The adhesive will then secure the strap in its position and even after the top adhesive strip and bottom adhesive strip are then cut, the adhesive is strong enough such that the strap will not break/slide free from the top adhesive strip and the bottom adhesive strip. This, the adhesive thereby prevents the strap from whipping around and causing a dangerous situation.

The words "strap" and "band" here can be used interchangeably. While a metal strap has been described herein, it can be appreciated that the strap can also be made of other materials as well, such as steel (a type of metal), plastic, rope, or any other material such straps/bands can be made out of.

Any description of a component or embodiment herein also includes hardware, software, and configurations which already exist in the prior art and may be necessary to the operation of such component(s) or embodiment(s).

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method, comprising:

providing a safety device comprising:

a restraining section with a first arm and a second arm and an opening between the first arm and the second arm;

a top adhesive strip connected to an end of the first arm and an end of the second arm; and a bottom adhesive strip connected to the top adhesive strip;

wrapping a metal strap around shipping materials;

placing the safety device under the metal strap;

tightening the strap around the shipping materials;

sealing the metal strap to the safety device, wherein the metal strap passes between the top adhesive strip and the bottom adhesive strip;

cutting the metal strap at a point on the top adhesive strip; and cutting the restraining section.

2. The method as recited in claim 1, wherein the safety device is configured such that upon the cutting the metal strap the safety device restrains the metal strap from whipping around.

3. The method as recited in claim 1, wherein upon the cutting the metal strap, the safety device restrains the metal strap from whipping around.

4. The method as recited in claim 1, wherein the restraining section is made of a material that stretches but is tear resistant.

5. The method as recited in claim 4, wherein the material is one of rubber, silicone, and plastic.

* * * * *